United States Patent [19]

d'Estaintot

[11] Patent Number: 4,869,045

[45] Date of Patent: Sep. 26, 1989

[54] APPARATUS FOR AUTOMATICALLY PLACING INTO BAGS ARTICLES DELIVERED AT THE EXIT OF A CHECK-OUT STATION

[75] Inventor: Pierre d'Estaintot, Meudon, France

[73] Assignee: Societe Anonyme Des Marches Usines-Auchan, Villeneuve D'Ascq, France

[21] Appl. No.: 155,801

[22] Filed: Feb. 16, 1988

[30] Foreign Application Priority Data

Feb. 16, 1987 [FR] France ..... 87 01947

[51] Int. Cl.[4] ..... B65B 43/26; B65B 17/00

[52] U.S. Cl. ..... 53/384; 53/390

[58] Field of Search ..... 53/390, 391, 459, 571, 53/572, 384; 186/66; 206/554

[56] References Cited

U.S. PATENT DOCUMENTS

| | | | |
|---|---|---|---|
| 3,352,411 | 11/1967 | Schwarzkopf | 206/554 X |
| 3,380,579 | 4/1968 | Pinto | 206/554 X |
| 3,747,298 | 7/1973 | Lieberman | 53/390 |
| 3,915,302 | 10/1975 | Farrelly et al. | 206/554 X |
| 3,973,376 | 8/1976 | Suominen | 53/390 X |
| 4,020,618 | 5/1977 | Benzon-Petersen et al. | 186/66 X |
| 4,106,733 | 8/1978 | Walitalo | 53/572 X |
| 4,291,517 | 9/1981 | Lipes | 53/468 |
| 4,306,633 | 12/1981 | Langen et al. | 53/390 X |
| 4,316,353 | 2/1982 | Suominen | 53/390 X |
| 4,676,378 | 6/1987 | Baxley et al. | 206/554 |

FOREIGN PATENT DOCUMENTS

| | | | |
|---|---|---|---|
| 79465 | 1/1982 | Australia | 206/554 |
| 1069455 | 8/1980 | Canada . | |
| 1526233 | 4/1968 | France . | |
| 2322783 | 1/1977 | France . | |

*Primary Examiner*—John Sipos
*Assistant Examiner*—Beth Bianca
*Attorney, Agent, or Firm*—Fisher, Christen & Sabol

[57] ABSTRACT

This invention relates to a process and apparatus for packing articles in bags, at a check-out desk of a self-service retail store, for example. It comprises, downstream of said check-out desk, a reserve of bags in the form of a stack of vertically stacked bags, with their side provided with handles and forming the opening, oriented upwardly, means for guiding a bag lying at the top of the stack, from an inactive position against the stack towards an active, open position, separated and detached from the stack, a conveyor lying from a zone plumb with said stack and terminating at an exit station, said conveyor allowing the bottom of the bag to rest thereon when the bag is full of articles introduced through its upper opening, said conveyor being associated with means for controlling its displacement and each face of a bag being connected to the opposite face of the adjacent bag by a detachable point of connection.

7 Claims, 6 Drawing Sheets

APPARATUS FOR AUTOMATICALLY PLACING INTO BAGS ARTICLES DELIVERED AT THE EXIT OF A CHECK-OUT STATION

The present invention relates to a process apparatus for packing articles collected together successively in one or more bags such as plastic bags with gussets and handles of known type.

Such process and apparatus allow automatic or semi-automatic collection of articles which are debited successively and one by one at the check-out desk and which must be evacuated, preferably being packed in individual bags.

The invention relates more precisely to an apparatus equipping check-out desks at the exits of self-service stores or supermarkets.

The problem of slow evacuation of the articles purchased by the customer leading to a bottleneck at the check-out, is all the more increased as the operation of billing, i.e. of calculation of the sum having to be paid by the customer, is at present rendered automatic by the use of optical or optoelectronic reading devices, particularly so-called "bar-code" systems.

At the present time, billing, i.e. the reading of the prices by an opto-electronic bar-code reading device, and carry-over on the customer's receipt, are effected automatically and extremely rapidly, with the result that the purchased articles accumulate after having passed through the check-out desk, this being a considerable source of delay which is detrimental to the output of the check-out desks in a self-service store; the staff suffers from such delay, as well as the customers who thus have to wait longer at the pay-desks.

There is therefore a need to render automatic or at least accelerate evacuation of the articles purchased by the customers after having passed through the check-out desk in a self-service store, so that the articles can be delivered in units grouped in a receptacle which is easy to hold.

The present invention responds to this need and provides a process and an apparatus for equipping check-out desks which continuously bill articles, such as one serving a self-service supermarket, this apparatus enabling the staff, without additional effort or work, to place the articles, after passage over the opto-electronic reading device, so that they will be received in receptacles which may be automatically guided and placed at the customer's disposal.

To that end, the invention relates to a process for packing articles, particularly at the packing station constituted by the check-out of a retail store, the purchased articles being collected together in plastic bags provided with handles, said process comprising the following successive operations of:

a) disposing at the packing station a reserve of stacked bags forming a compact stack, by engaging on two lateral parallel rods the perforations provided on the handles of the bags, each face of a bag being provided in connecting contact with the face of the adjacent bag by a detachable connecting means such as a glued zone, spot of glue or fine tongue of material, the stacked bags constituting a large reserve enabling the bags to be delivered individually as they are needed;

b) the bag at the top of the stack is separated and opened in position for filling, the two faces of the bag being separated and gaping so as to enable the articles to be conveniently introduced through the top opening;

c) the bag, once filled with articles, is moved towards an exit station adapted to receive the filled bag, thus placed at the disposal of the customer who then evacuates his/her packed purchases;

d) the evacuated bag takes along in its movement a face of the following bag which is thus in turn brought into open position for filling, and in the subsequent traction corresponding to the continuation of the movement of the evacuated bag, the detachable point of connection breaks and the two bags are then separated, the evacuated bag arriving at the exit station whilst a new bag may receive the articles billed thereafter.

The invention also relates to an apparatus for carrying out the process described hereinabove for packing articles collected together in bags, such as plastic bags with gussets and handles, the apparatus being adapted to equip a check-out and article-evacuating station, such as the check-out desk of a self-service retail store, to pack and evacuate the purchased articles after they have passed through the check-out, wherein it comprises, downstream of said check-out desk, a reserve of bags in the form of a stack of vertically stacked bags, with their side provided with handles and forming the opening, oriented upwardly, the apparatus further comprising means for guiding a bag lying at the top of the stack, from an inactive position against the stack towards an active, open position, separated and detached from the stack, the two faces of the bag gaping in open position for filling, and the apparatus allows displacement of the bag from its position of filling towards a position for evacuation.

The invention will be more readily understood on reading the following description with reference to the accompanying drawings, in which.

Figure 7:
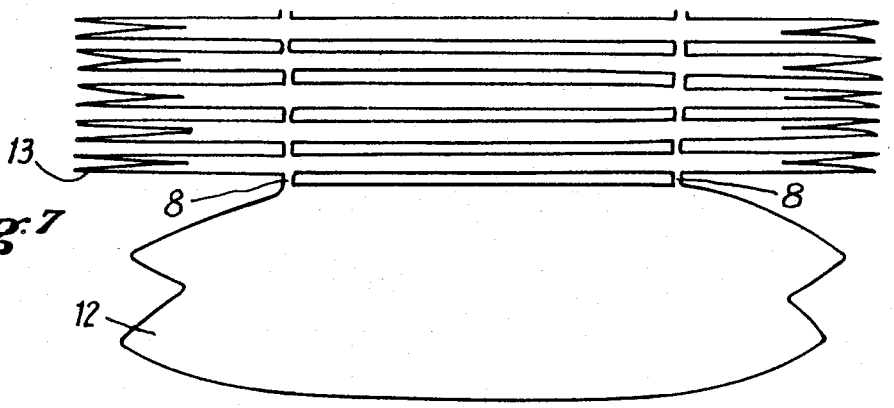

FIG. 7 schematically shows in plan a view of the stack of bags.

Referring now to the drawings, all the FIGURES show that the apparatus comprises a reserve of stacked bags forming a compact stack 1 of known type.

These bags are for example made of plastic material and are of the type with gussets and with two upper handles 3, 3' for holding.

The handles 3, 3' comprise perforations 4, 4' which allow engagement thereof on two upper lateral rods 5 and 5'.

The bags are stacked, constituting a considerable reserve enabling them to be delivered individually as they are needed; their number may attain five hundred.

As shown in the different FIGURES, as the apparatus is used, a top bag is separated from the rear stack and brought into open position for filling, the two faces of the bag, 6 and 6' respectively, being separated and gaping so as to allow convenient introduction of the purchased articles 7, 7' through the top opening thus formed.

Figure 1A:
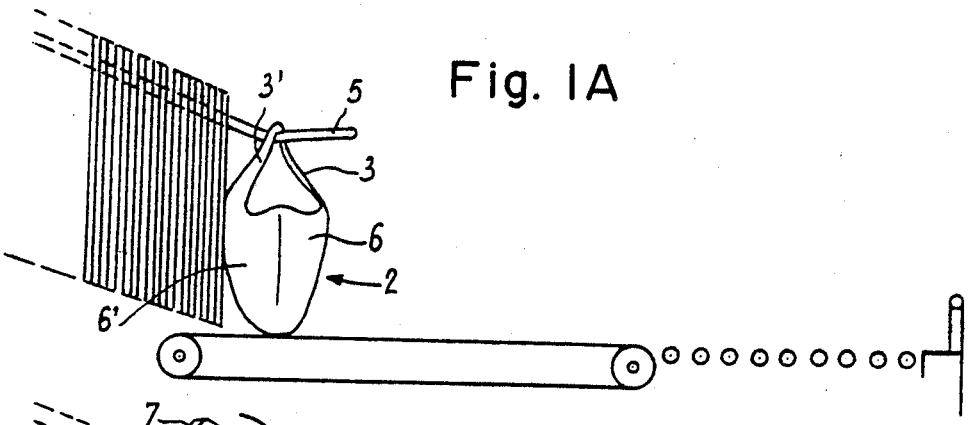
FIG. 1A through 1D represent a schematic view of the working principle of the device according to the invention, showing four successive phases of operation of this device.
Figure 1B:
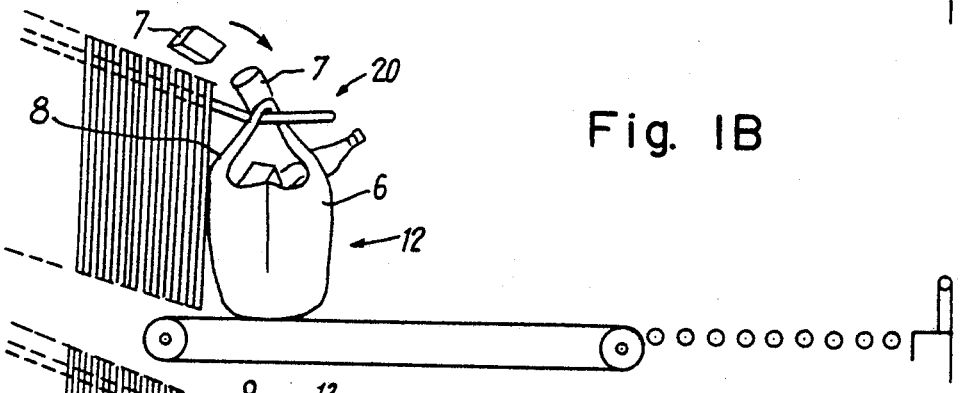
Figure 1C:
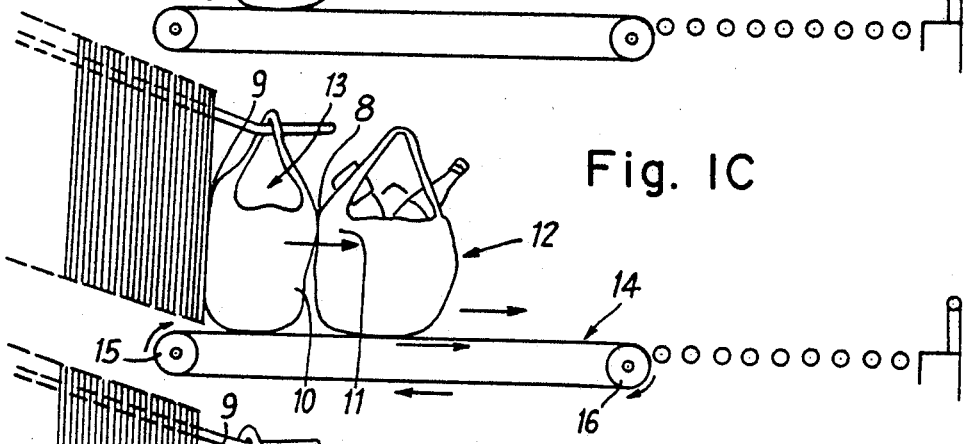
Figure 1D:
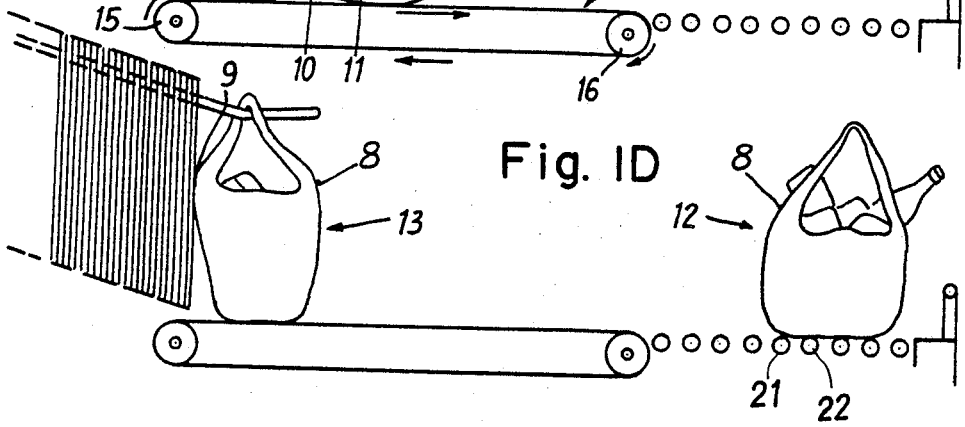

To that end, and as shown in FIG. 1C, the rear face of each bag 11 is in connecting contact with the face front 10 of the adjacent bag by a detchable connecting means constituted for example by a gluing zone, a spot of glue or a fine tongue of material (references 8, 9, FIGS. 1C and 7).

The detachable connecting means is exactly calibrated so as to allow the face 10 of the subsequent bag to be taken along by the rear face 11 of the evacuated bag (as shown by the arrow in FIG. 1C), the two faces 10 and 11 being initially against each other.

The detachable connecting means is calibrated so as to withstand the pulling force necessary for moving apart the faces of the subsequent bag so as to obtain opening of the bag; however, when the subsequent bag is open, the resistance of the subsequent bag increases (as it itself remains fast by its rear face with the stack), and the connecting means 8 gives way, ensuring detachment of the downstream bag 12 in the course of evacuation with respect to the upstream bag 13.

Displacement of the bag 12 (FIGS. 1B and 1C) is obtained by actuation of a lower conveyor belt 14 driven over end cylinders 15 and 16 and resting on intermediate rollers 17, 18, 19 etc.

The conveyor belt 14 leaves from the filling station 20 corresponding to the positioning of the bag brought into open position for filling, said conveyor 14 taking the bag once filled towards an exit station constituted for example by a succession of idle rollers 21, 22, etc., respectively, of known type, adapted to receive the filled bag and taking it towards the customer who can thus take his/her packed purchases.

The conveyor belt 14 is located immediately below the stack of bags 1 suspended from the rods 5, 5', so that, when a bag is being filled, the articles come to rest on the conveyor belt 14, due to the suppleness and elasticity of the material constituting the bag.

It will be understood that, when the bag is filled, the conveyor belt may be actuated and the filled bag is then detached, the upper handles separating from the rods 5, 5', whilst the evacuated bag takes along in its movement one face of the following bag which is thus in turn brought into position for filling; in the subsequent traction corresponding to the continued movement of the evacuated bag, the detachable connection point 8 breaks and the two bags are then separated, evacuated bag 12 arriving at the exit station whilst bag 13 may receive the articles which are billed thereafter.

The conveyor belt may easily be set into motion by the staff controlling a simple pedal 27. In this way, the operator, as soon as a bag is filled, and whilst keeping his/her hands free, can automatically evacuate this bag, thus bringing the following bag into active position for filling, under likewise automatic conditions.

In order to ensure that the stack of bags 1 remains compressed and consequently to ensure its compacted position and to avoid the bags becoming detached and being released in uncontrolled manner, the whole stack of bags is mounted on a blocking pin 23.

Figure 4:
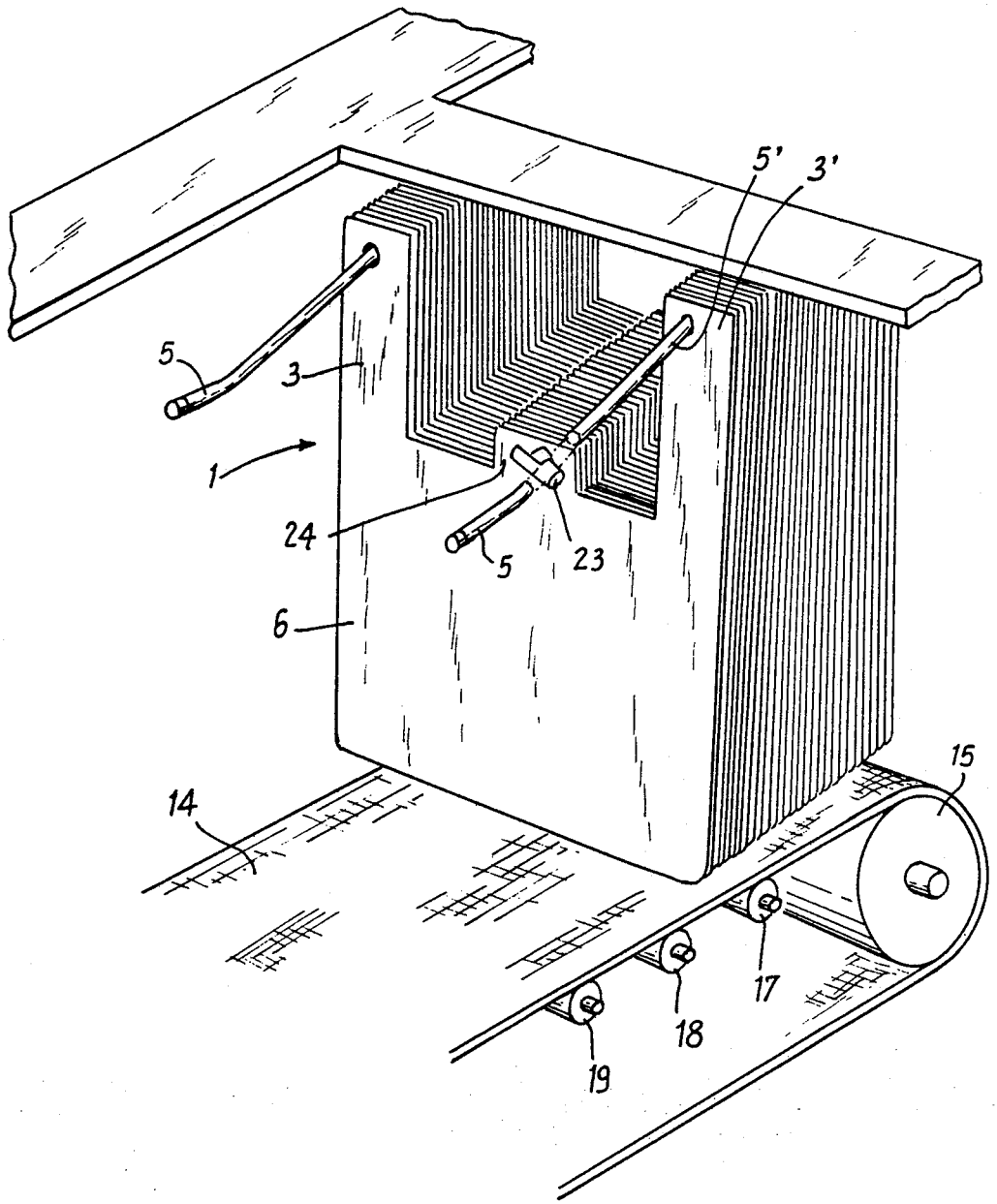
FIG. 4 shows a view in detail of the stack of bags within the framework of the apparatus according to the invention, whilst
Figure 5:
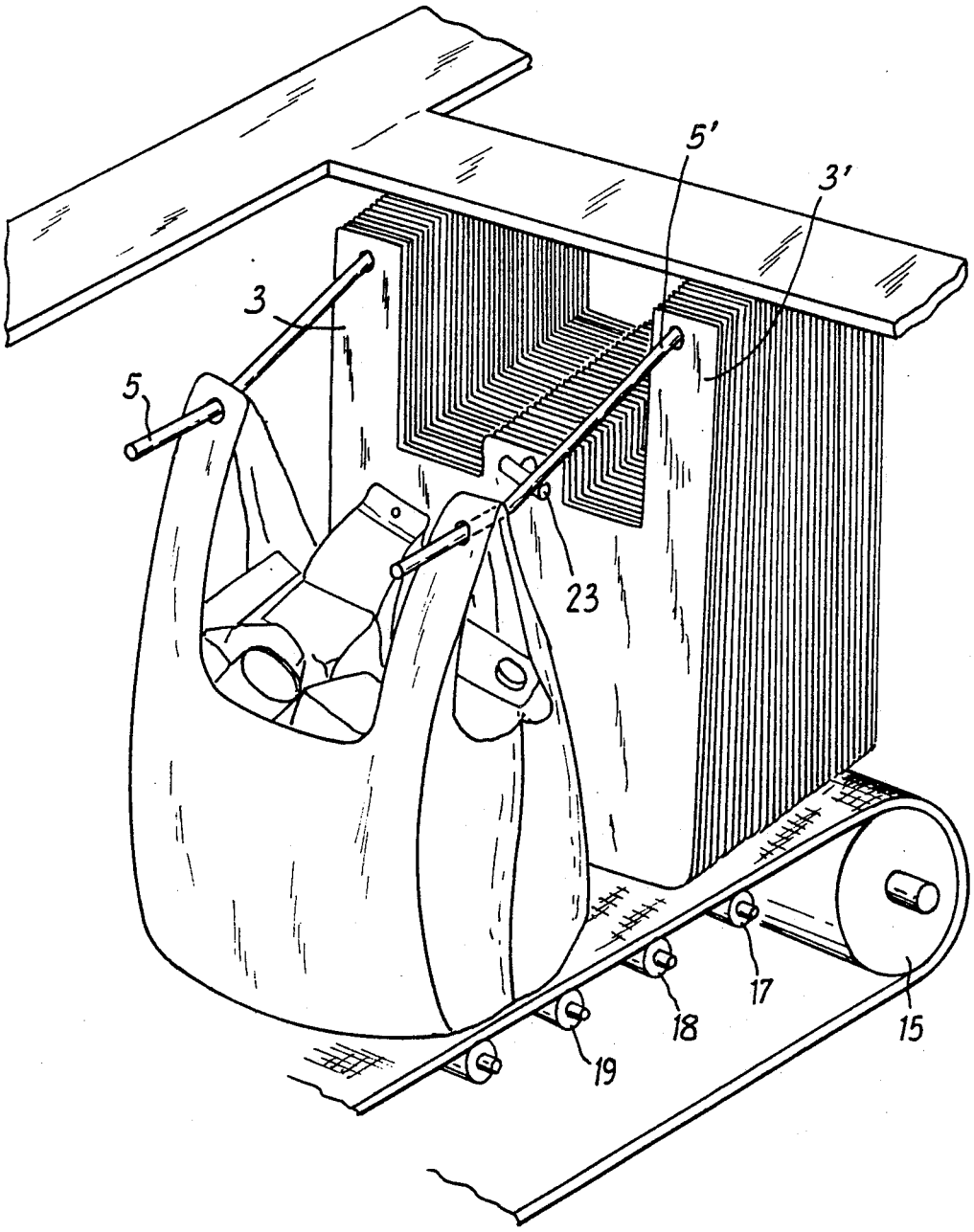
FIG. 5 shows the same view, one bag having been brought into open position and being in the course of being filled.
Figure 6A:
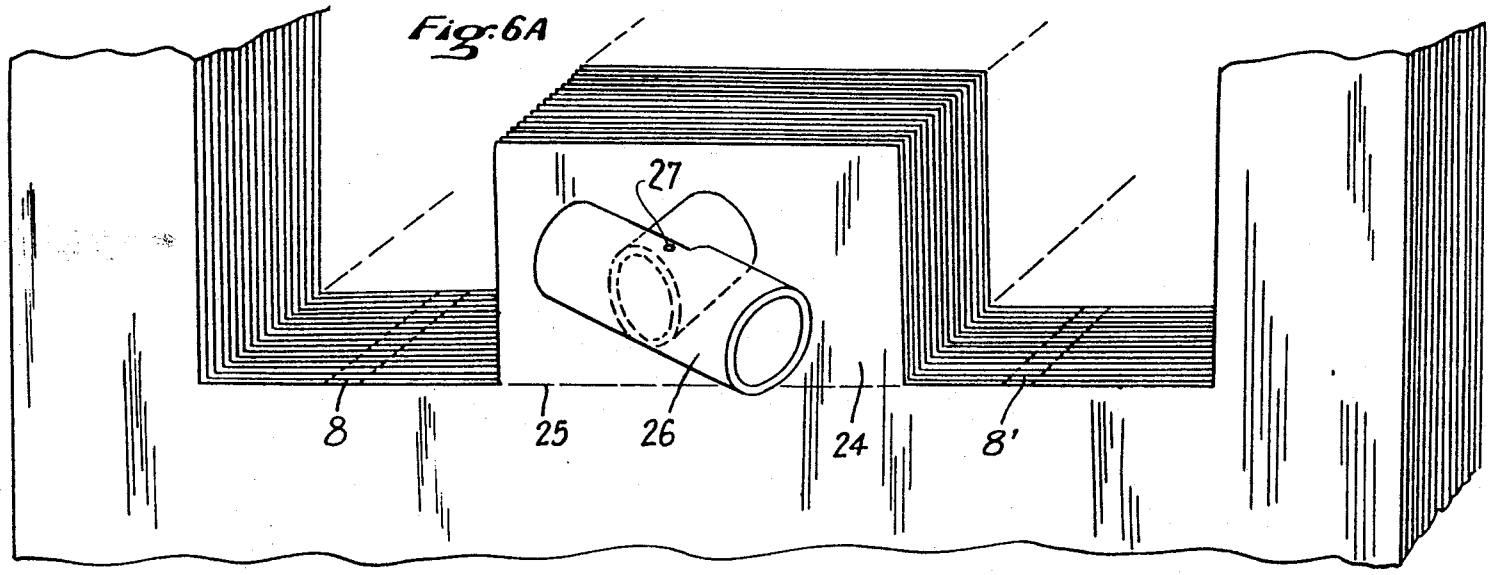
FIGS. 6A and 6B are two views of the catch with which the blocking pin is fitted.
Figure 6B:
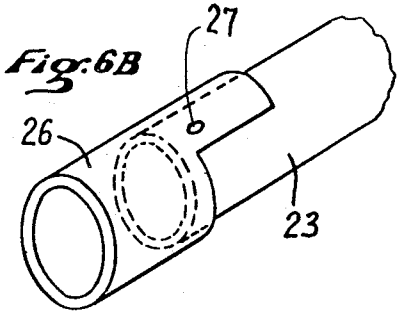

This pin 23 is engaged in the slots or perforations provided in register in the projecting lobe elements 24 provided on the upper edge of the side face 6 of a bag (FIGS. 4 and 6A, 6B).

This lobe 24 is separated from the corresponding face 6 by a line of weakness 25 which allows separation of face 6 with respect to lobe 24 which remains blocked on the pin 23.

Immobilization of the lobes 24 stacked on the pin 23 is ensured by an end catch 26 formed at least partially by a segment of cylinder and this catch 26 is articulated at 27 on the end of the pin and may thus pass from a colinear position with respect to pin 23 and in line therewith to allow engagement of the openings and pinning of the lobes 24, after which the catch 26 is taken to transverse blocking position and it thus holds the stack of bags in its compacted position.

Figure 2:
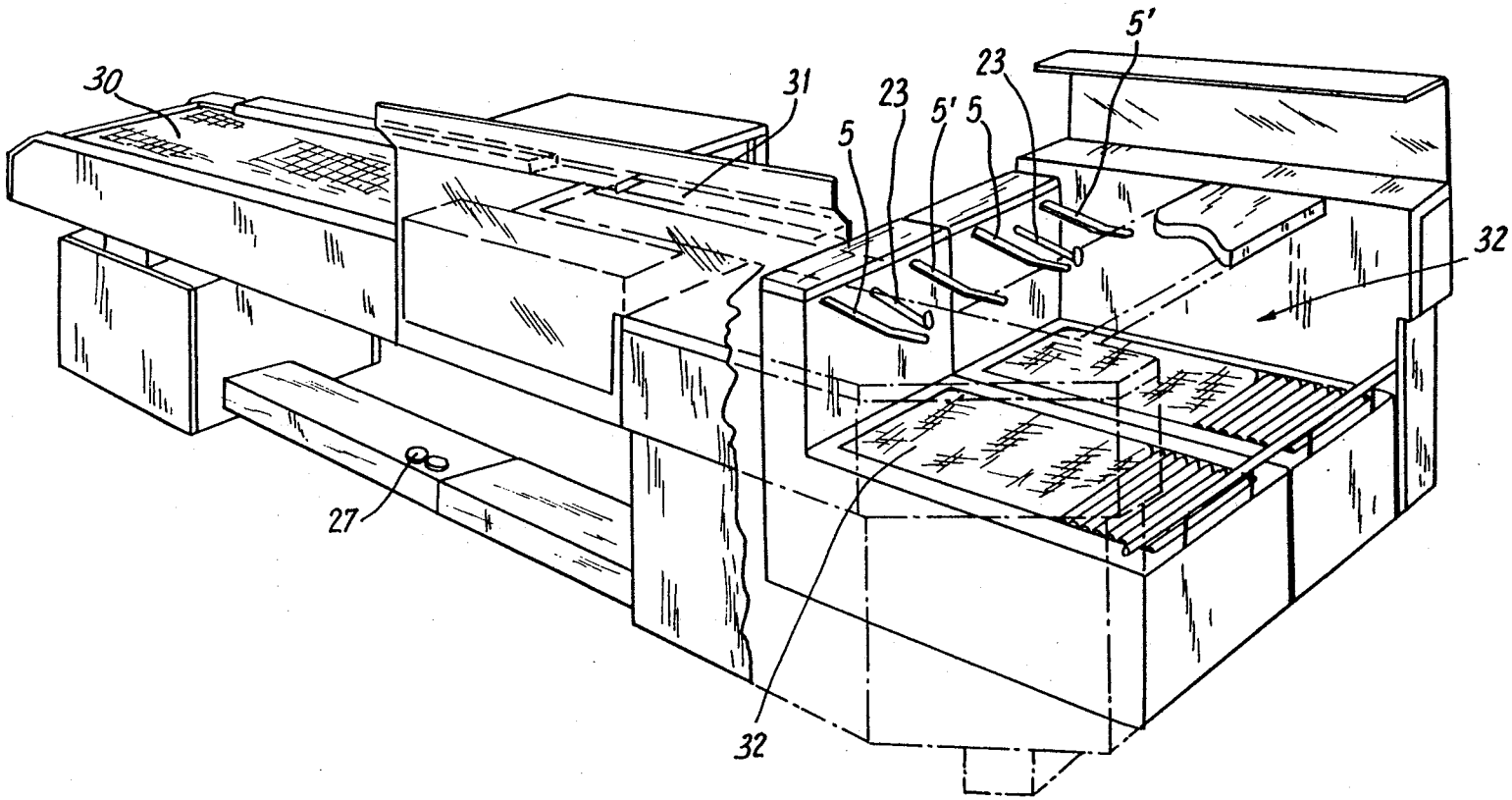
FIG. 2 shows a view in perspective, with parts torn away, of a check-out desk serving a self-service retail store, equipped with two packing apparatus according to the invention, in twinned position.
Figure 3:
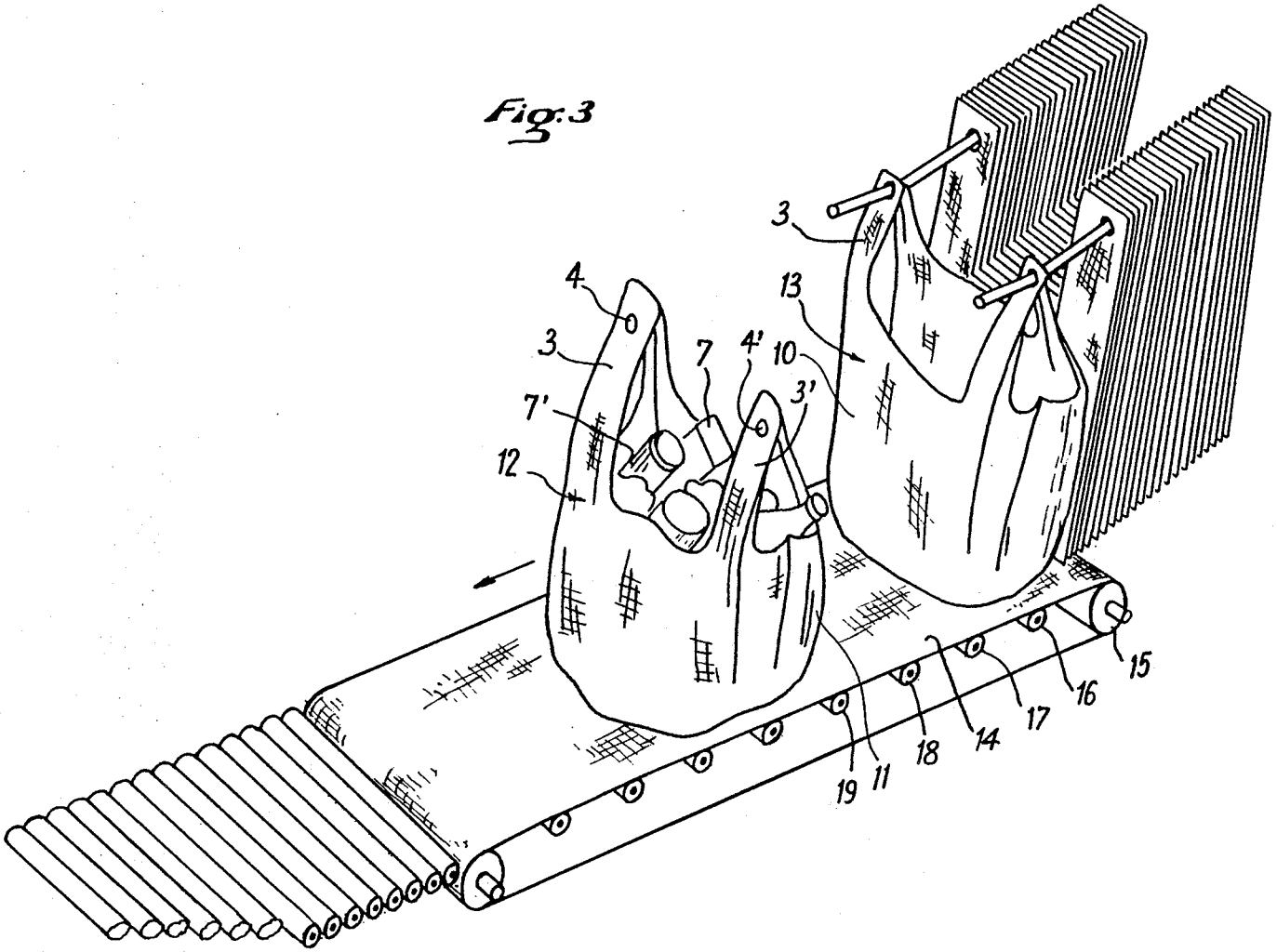
FIG. 3 shows a general view in perspective of the packing device according to the present invention.

FIG. 2 shows an overall view of a check-out desk in a self-service store in which the automatic packing system according to the invention is integrated.

In the present case, it will be noted that the packing station comprises two twinned devices. Twinning of two devices side by side presents numerous advantages.

Firstly, it makes it possible to continue the operation of filling and consequently the billing of the articles at the pay-desk during the time corresponding to the evacuation of one bag and the opening of the subsequent bag, with the result that the operator always has an open bag available.

Furthermore, the twinning of evacuation devices might enable each of the two devices to be allocated to a type of product: for example, each of the devices may receive a stack of bags presenting particular characteristics, for example strength, format, etc . . . , which would give each of the automatic packing devices a particular vocation, one of the devices preferably receiving light articles, whilst the other (equipped with stronger bags) receiving heavier articles.

FIG. 2 shows an upstream conveyor belt 30 on which the customer places his/her purchases, this belt serving as storage station and at the same time bringing the articles successively towards the billing station 31; at this station, the staff effects automatic reading of the articles and the billing operations may thus be carried out particularly rapidly, the billed data being for example displayed on display means (not shown).

Immediately downstream are located the two automatic packing stations or devices 32 and 32' respectively, each comprising, as specified hereinbefore, a lower conveyor belt 14, the receiver rollers at the exit station where the customer can take his/her purchases simply by gripping the handles of the bags in which they are packed. In FIG. 2, in order to render the drawing clearer, the packing devices have been shown empty of bags.

In accordance with an important feature of the invention, the rods 5, 5' for guiding and holding the bags (stacked and suspended by the perforations 4, 4' of the handles 3, 3' fitting on said rods) are inclined downwardly towards their free end, thus facilitating slide of the handles of the bag from its stored position to its open position for filling, the terminal part of each rod being horizontal.

The pin 23 for blocking the bags is shorter than the inclined part of rods 5, 5', so that the reserve of stacked bags is maintained on this inclined zone.

Each bag drawn by the departure of the evacuated bag therefore slides by its handles over the inclined part of the rods, the detachable lobe 24 remaining blocked in place after rupture of the line of weakness 25 (FIG. 6A).

The bridge of material 8 joining the evacuated bag to the pulled bag in fact withstands the low antagonistic friction force encountered by the handles sliding on the inclined plane constituted by the inclined part of the rods 5, 5'.

When the handles 3, 3' arrive on the horizontal terminal part of rods 5, 5', the effect of slide assisted by the slope stops and beyond the threshold constituted by the transition of the inclined planes towards the horizontal part, the resistance opposed by the displacement of the handles increases; and the bridges of material 8 are calibrated so as to resist the low force of traction exerted on the handles sliding on the inclined rods, but so as to yield to the slightly greater force of friction exerted on the handles when the latter must move over the horizontal terminal part of the rods, i.e. exceeding 1 kg.

In this way, the bag drawn by the evacuated bag is automatically taken along until the drawn bag comes into position for filling, its two faces gaping, since the downstream face is taken along by the evacuated bag, whilst the other face remains fast with the stack of bags.

For its part, the evacuated bag may move by its handles over the horizontal part of the rods, this bag being taken along by the conveyor 14 until the handles separate from these rods 5, 5'. Rupture of the bridges 8, described previously, allows the subsequent path of the evacuated bag independently of the drawn bag which remains at the filling station.

What is claimed is:

1. An apparatus for packing articles collected together in bags, such as plastic bags with gussets and handles, the apparatus being adapted to equip a check-out and article-evacuating station, such as the check-out desk of a self-service retail store, wherein downstream of said check-out desk, said apparatus comprises:

(a) a reserve of bags in the form of a stack of vertically stacked bags, in which each bag is constituted by two faces joined by their bottom and sides and includes upper handles provided with slots for hanging, and each rear face of the first bag is detachably fast with the front face there opposite belonging to the subsequent adjacent bag, by a separable connecting means adapted to yield beyond a determined force of traction of the first bag on the said subsequent bag, the upper side of each bag provided with an opening which includes at least one separable projecting holed lobe element connected to the corresponding upper side of the bag by a line of weakness;

(b) means for guiding the successive bags comprising two lateral rods inserted in said slots for hanging, in register from one bag to the other on the whole of the stack, these slots in register being engaged on said rods so that the stack of bags is suspended from said rods such that a first bag at the top of the stack may be displaced from an inactive position against the stack towards a position wherein one face of the bag is separated from the stack, allowing the bag to be brought into an open position and to be filled, and said rods for hanging and guiding the bags are inclined downwardly towards their free end, thus facilitating the sliding motion of the handles of a drawn bag from its storage position towards its open position for filling, the terminal part of each rod being horizontal, thus causing an increase in the resistance opposed to the subsequent sliding motion of the handles along the rods beyond the threshold constituted by the transition of the inclined rods towards the horizontal part, said increase in resistance ensuring that said separable connection means disposed between the rear face of the drawn bag and the front face of the subsequent bag will yield;

(c) means for retaining the stack of bags comprising at least one blocking pin inserted in a central hole in said separable lobe element, and including at its end of a lockable catch preventing the stack of lobe elements from escaping; and (d) a conveying means in the form of an endless belt disposed from a zone plumb with said stack and terminating so as to form an exit station, said belt being adapted to receive the bottom of the bag prior to separation from said subsequent bag once said bag is in open position and being filled, such that the bottom of the bag rests on the belt, said belt including mechanical means for controlling the displacement of said belt and ensuring the advance of the bag from its open position for opening said subsequent bag due to said separable connecting means; for separating said bag from said subsequent bag once said subsequent bag is opened and for moving said bag at least concurrent with the separation of said bag from said lobe element towards a position of evacuation at the end of said conveying means.

2. The apparatus of claim 1, wherein the separable connection means joining a rear face of one bag to the front face of the subsequent bag is calibrated so as to resist the weak force of traction exerted on the handles sliding on the inclined part of the rods, but so as to yield to the slightly greater force of friction exerted on the handles when the latter must move over the horizontal terminal part of the rods.

3. The apparatus of claim 1, wherein said separable connecting means joining a rear face of one bag to the front face of the subsequent bag is adapted to yield when the force of traction of one bag on the other exceeds one kilo.

4. The apparatus of claim 1, wherein the separable connecting means if formed by a layer of adhesive in interstitial position between the rear face of one bag and the front face of the subsequent bag.

5. The apparatus of claim 1, wherein said separable connecting means positioned between the rear face of one bag and the front face of the subsequent bag is formed by two bridges of material integral with both of said faces and adapted to yield beyond a force of traction exceeding one kilo.

6. The apparatus of claim 1 further comprising a second apparatus comprising the same elements as said first apparatus with each apparatus comprising one conveying belt and a set of rods for hanging a set of bags, whereby it is possible to continue the operation of filling a bag in open position while a preceding bag is being evacuated, and whereby said assembly will automatically bring a following bag into open position.

7. An apparatus for facilitating the packing of articles into plastic bags having a front and rear face, a pair of sides, a sealed bottom, an open upper edge forming a mouth, a pair of looped handles disposed at the upper edge of said sides and including an aperture disposed in each of said handles, and a detachable tab releasably fastened to said mouth and including an aperture whereby said detachable tab may be attached to said apparatus, said apparatus, comprising:

(a) a pair of parallel rods whereupon a plurality of said bags may be disposed by means of inserting said rods through said pair of apertures disposed within the handles of said bags; wherein, with said plurality of bags, the rear face of a preceding bag is releasably attached to the front face of a succeeding bag by an attachment means such that when said preceding bag is pulled along and off of said rods, said succeeding bag will also be pulled along said rods, whereby the mouth of said succeeding bag will be opened, said rods having a bend disposed therein such that the portion of said rods first encountered by said bags as said bags are moved along said rods away from said plurality of bags is downwardly-sloping, whereas the second portion of said rods encountered by said bags is substantially horizontal, whereby the resistance provided by said rods to the motion of said bags will increase along the length of said rods;

(b) means for retaining said plurality of bags near the top of said downwardly-sloping portion of said parallel rods until said detachable tab has been severed, said means for retaining said plurality of bags being fastened to said plurality of bags through said aperture disposed within said detachable tab, whereby once said detachable tab has been severed from a first one of said bags, said detachable tab will remain fastened to said means for retaining said plurality of bags and said first bag will slide down the downwardly-sloping portion of said parallel rods until said first bag reaches the horizontal portion of said rods, at which point the resistance to further movement by said first bag posed by said bags which remain fastened to said retaining means, and which is conveyed to said first bag by said attachment means will arrest the motion of said first bag; and (c) conveying means for moving said bags, after each of said bags has become positioned at the juncture of the downwardly-sloping portion and the horizontal portion of said parallel rods and after each of said bags has been packed with articles, off of and away from said parallel bars, said conveying means being operably connected to remote control means, whereby said conveying means may be activated and each of said bags filled with articles may be conveyed off of, and away from said parallel bars at least concurrent with the severing of said bag from said detachable tab without requiring that each of said bags filled with articles be manually removed from said parallel bars, said conveying means also generating sufficient force for opening said succeeding bag as said preceding bag pulls said succeeding bag due to its attachment means and then for serving said attachment means, whereby said bag filled with articles is separated from the succeeding bag, and whereby said succeeding bag is allowed to slide down the downwardly-sloping portions of said parallel rods and thereafter be filled with said articles.

* * * * *